US009996041B2

(12) United States Patent
Kishi et al.

(10) Patent No.: US 9,996,041 B2
(45) Date of Patent: Jun. 12, 2018

(54) BELT FEEDING DEVICE AND IMAGE FORMING APPARATUS

(71) Applicant: CANON KABUSHIKI KAISHA, Tokyo (JP)

(72) Inventors: Takehiro Kishi, Toride (JP); Keita Shigihara, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/198,863

(22) Filed: Jun. 30, 2016

(65) Prior Publication Data

US 2017/0003636 A1 Jan. 5, 2017

(30) Foreign Application Priority Data

Jul. 2, 2015 (JP) ..... 2015-133767

(51) Int. Cl.

| | |
|---|---|
| ***G03G 21/16*** | (2006.01) |
| ***G03G 15/00*** | (2006.01) |
| ***G03G 15/16*** | (2006.01) |
| *G03G 21/00* | (2006.01) |

(52) U.S. Cl.

CPC ..... *G03G 15/6529* (2013.01); *G03G 15/1605* (2013.01); *G03G 15/1685* (2013.01); *G03G 21/0035* (2013.01); *G03G 2215/00675* (2013.01); *G03G 2215/1623* (2013.01)

(58) Field of Classification Search

CPC ..... G03G 15/1605; G03G 15/1685; G03G 15/6529; G03G 21/0035; G03G 2215/00675; G03G 2215/1623; G03G 2215/16; G03G 2215/1614; G03G 2215/1619; G03G 2215/2061

USPC ..... 399/121

See application file for complete search history.

(56) References Cited

U.S. PATENT DOCUMENTS

| | | | |
|---|---|---|---|
| 8,521,044 | B2 | 8/2013 | Suzuki |
| 8,588,637 | B2 | 11/2013 | Nakamura et al. |

FOREIGN PATENT DOCUMENTS

| | | | |
|---|---|---|---|
| JP | 2011-028112 | A | 2/2011 |
| JP | 2011-221230 | A | 11/2011 |
| JP | 2011-242527 | A | 12/2011 |
| JP | 2012-237911 | A | 12/2012 |
| JP | 2013-045083 | A | 3/2013 |

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

A belt feeding device includes a belt, a first roller, an opposing roller, a second roller, and a brush roller. $(|D2s-D2m|/2)\times 10 \geq \lambda \geq (|D2s-D2m|/2)\times(b/(a+b))$ is satisfied, where D2m is a minimum diameter of the first roller, D2s is a maximum diameter of the first roller, λ is an entering amount of the opposing roller into the brush roller with respect to a reference line A between a portion of the first roller having the minimum diameter D2m and the second roller, a is a distance between a line passing through a rotation center of the first roller and a line passing through a rotation center of the opposing roller, and b is a distance between a line passing through a rotation center of the second roller and a line passing through the rotation center of the opposing roller.

9 Claims, 7 Drawing Sheets

BELT FEEDING DEVICE AND IMAGE FORMING APPARATUS

FIELD OF THE INVENTION AND RELATED ART

The present invention relates to a belt feeding device including an endless belt stretched by a plurality of stretching rollers and an image forming apparatus, such as a copying machine, a printer or a facsimile machine, using an electrophotographic type or an electrostatic recording type in which the belt feeding device is provided.

Conventionally, in the image forming apparatus using the electrophotographic type or the electrostatic recording type, the toner image is formed on an image bearing member (first image bearing member) such as an electrophotographic photosensitive member or an electrostatic recording dielectric member by an appropriate image forming process. This toner image is directly transferred onto a transfer(-receiving) material or is secondary-transferred onto the transfer material after being once primary-transferred onto an intermediary transfer member (second image bearing member). As the intermediary transfer member, an endless belt (intermediary transfer belt) is used in many cases. As the photosensitive member or the electrostatic recording dielectric member, an endless belt (photosensitive (member) belt, electrostatic recording dielectric (member) belt) is used in some cases. Further, between the image bearing member, such as the photosensitive member, the electrostatic recording dielectric member or an intermediary transfer member, and a transfer member for transferring the toner image from the image bearing member onto the transfer material, an endless belt (transfer belt) is sandwiched and fed together with the transfer material in some cases. Each of these endless belts of various types is stretched by a plurality of stretching rollers and is rotated (circulated or moved).

In the above-described image forming apparatus, as a cleaning type in which deposited matter such as toner deposited on the various belts is removed, a fur brush cleaning type using a fur brush as a cleaning member is used. Particularly, an electrostatic fur brush cleaning type, in which a bias of an opposite polarity to a charge polarity of the toner is applied to an electroconductive fur brush and thus the toner is electrostatically attracted from a member-to-be-cleaned to the fur brush thereby cleaning the member-to-be-cleaned, may preferably be used. As the fur brush, a rotatable fur brush roller is used in many cases.

In Japanese Laid-Open Patent Application Nos. (JP-A) 2011-242527 and (JP-A) 2013-45083, an image forming apparatus in which the fur brush cleaning type is employed and an opposing member such as an opposing roller is provided at a position opposing the fur brush via the belt is disclosed.

Here, the belt stretched by the plurality of stretching rollers causes crease due to a variation in structure of the stretching rollers in some cases. For example, when the crease generates at a transfer portion of the toner image on the intermediary transfer belt or the transfer belt, image defect generates, and therefore it is desired that the crease of the belt is controlled. In order to control the crease of the belt, JP-A 2012-237911 discloses an image forming apparatus using a crown roller having a crown shape as a stretching roller.

As described above, for example, in order to control the crease on an objective surface of the belt at a portion such as the toner image transfer portion, it is effective to use the crown roller having the crown shape as the stretching roller.

However, when the crease generated on the belt is intended to be controlled (eliminated) by this method, the crease on the objective surface can be eliminated, but on the other hand, another crease generates on another surface in some cases.

For example, in order to suppress the image defect, when creases generated upstream and downstream of the toner image transfer portion with respect to a rotational direction of the belt are intended to be eliminated, a crease generates on a surface (cleaning surface) to be cleaned by a fur brush for the belt in some cases. When the crease generates on the cleaning surface, a cleaning performance of the fur brush fluctuates between a recessed portion and a projected portion of the crease, so that improper cleaning generates in some cases.

SUMMARY OF THE INVENTION

According to an aspect of the present invention, there is provided a belt feeding device comprising: a movable endless belt configured to feed a recording material on which a toner image is carried; a plurality of rollers contacting an inner peripheral surface of the belt and including a first roller, an opposing roller and a second roller, wherein the first roller is smaller in diameter at a central portion than at an end portion in a region including a belt contact region thereof with respect to a rotational axis direction thereof, wherein the opposite roller is provided downstream of and adjacent to the first roller with respect to a movement direction of the belt and is constant in diameter in a region including a belt contact region thereof with respect to a rotational axis direction thereof, wherein the second roller is provided downstream of and adjacent to the opposing roller with respect to the movement direction of the belt and is constant in diameter in a region including a belt contact region thereof with respect to a rotational axis direction thereof; and a rotatable brush roller configured to remove toner deposited on an outer peripheral surface of the belt, wherein the brush roller is provided at a position opposing the opposing roller via the belt and contacts the outer peripheral surface of the belt, wherein the following relationship is satisfied: $(|D2s-D2m|/2)\times 10 \geq \lambda \geq (|D2s-D2m|/2)\times(b/(a+b))$, where as seen in the rotational axis directions, D2m is a minimum diameter of the first roller, D2s is a maximum diameter of the first roller, $\lambda$ is an entering amount in which an outer peripheral surface of the opposing roller enters the brush roller with respect to a reference line A which is an outer common tangential line at a stretching side of the belt between a portion of the first roller having the minimum diameter D2m and the second roller, a is a distance between a rectilinear line passing through a rotation center of the first roller and perpendicular to the reference line A and a rectilinear line passing through a rotation center of the opposing roller and perpendicular to the reference line A, and b is a distance between a rectilinear line passing through a rotation center of the second roller and perpendicular to the reference line A and the rectilinear line passing through the rotation center of the opposing roller and perpendicular to the reference line A.

According to another aspect of the present invention, there is provided a belt feeding device comprising: a movable endless belt configured to feed a recording material on which a toner image is carried; a plurality of rollers contacting an inner peripheral surface of the belt and including a first roller, an opposing roller and a second roller, wherein the first roller is different in diameter at a central portion from at an end portion in a region including a belt contact region thereof with respect to a rotational axis direction thereof, wherein the opposite roller is provided downstream of and adjacent to the first roller with respect to a movement direction of the belt and is constant in diameter in a region including a belt contact region thereof with respect to a rotational axis direction thereof, wherein the second roller is provided downstream of and adjacent to the opposing roller with respect to the movement direction of the belt and is constant in diameter in a region including a belt contact region thereof with respect to a rotational axis direction thereof; and a rotatable brush roller configured to remove toner deposited on an outer peripheral surface of the belt, wherein the brush roller is provided at a position opposing the opposing roller via the belt and contacts the outer peripheral surface of the belt, wherein the following relationship is satisfied: $(|D2max-D2min|/2)\times10\geq\lambda\geq|D2max-D2min|/2)\times(b/(a+b))$, where as seen in the rotational axis directions, D2max is a maximum diameter of the first roller, D2min is a minimum diameter of the first roller, $\lambda$ is an entering amount in which an outer peripheral surface of the opposing roller enters the brush roller with respect to a reference line A which is an outer common tangential line at a stretching side of the belt between a portion of the first roller having the minimum diameter D2min and the second roller, a is a distance between a rectilinear line passing through a rotation center of the first roller and perpendicular to the reference line A and a rectilinear line passing through a rotation center of the opposing roller and perpendicular to the reference line A, and b is a distance between a rectilinear line passing through a rotation center of the second roller and perpendicular to the reference line A and rectilinear line passing through the rotation center of the opposing roller and perpendicular to the reference line A.

According to a further aspect of the present invention, there is provided an image forming apparatus comprising: a toner image forming unit configured to form a toner image; an intermediary transfer member configured to temporarily carry the toner image which is formed by the toner image forming unit and which is transferred onto a recording material; a movable endless belt configured to feed the recording material to which the toner image is transferred from the intermediary transfer member; a plurality of rollers contacting an inner peripheral surface of the belt and including a first roller, an opposing roller and a second roller, wherein the first roller is smaller in diameter at a central portion than at an end portion in a region including a belt contact region thereof with respect to a rotational axis direction thereof, wherein the opposite roller is provided downstream of and adjacent to the first roller with respect to a movement direction of the belt and is constant in diameter in a region including a belt contact region thereof with respect to a rotational axis direction thereof, wherein the second roller is provided downstream of and adjacent to the opposing roller with respect to the movement direction of the belt and is constant in diameter in a region including a belt contact region thereof with respect to a rotational axis direction thereof; and a rotatable brush roller configured to remove toner deposited on an outer peripheral surface of the belt, wherein the brush roller is provided at a position opposing the opposing roller via the belt and contacts the outer peripheral surface of the belt, wherein the following relationship is satisfied: $(|D2s-D2m|/2)\times10\geq\lambda\geq(|D2s-D2m|/2)\times(b/(a+b))$, where as seen in the rotational axis directions, D2m is a minimum diameter of the first roller, D2s is a maximum diameter of the first roller, $\lambda$ is an entering amount in which an outer peripheral surface of the opposing roller enters the brush roller with respect to a reference line A which is an outer common tangential line at a stretching side of the belt between a portion of the first roller having the minimum diameter D2m and the second roller, a is a distance between a rectilinear line passing through a rotation center of the first roller and perpendicular to the reference line A and a rectilinear line passing through a rotation center of the opposing roller and perpendicular to the reference line A, and b is a distance between a rectilinear line passing through a rotation center of the second roller and perpendicular to the reference line A and the rectilinear line passing through the rotation center of the opposing roller and perpendicular to the reference line A.

Further features of the present invention will become apparent from the following description of exemplary embodiments with reference to the attached drawings.

DESCRIPTION OF THE EMBODIMENTS

A belt feeding device and an image forming apparatus according to the present invention will be described with reference to the drawings.

Embodiment 1

1. General Constitution and Operation of Image Forming Apparatus

Figure 1:
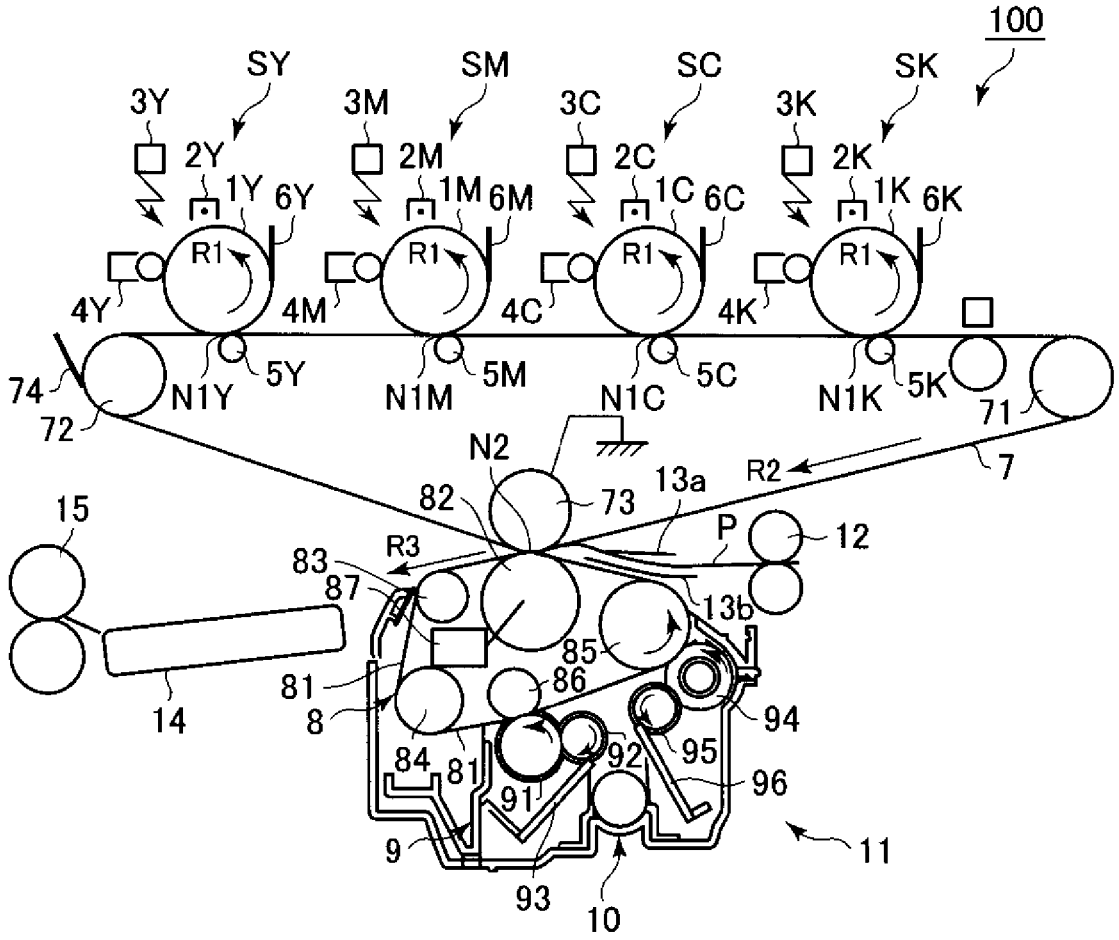
FIG. 1 is a schematic sectional view of an image forming apparatus according to Embodiment 1 of the present invention.

FIG. 1 is a schematic sectional view of an image forming apparatus 100 according to Embodiment 1 of the present invention.

The image forming apparatus 100 in this embodiment is a tandem laser beam printer which is capable of forming a full-color image using an electrophotographic type and which employs an intermediary transfer type.

The image forming apparatus 100 includes, as a plurality of image forming portions (stations), first to fourth image forming portions SY, SM, SC and SK for forming images of yellow (Y), magenta (M), cyan (C) and black (K), respectively. In this embodiment, constitutions and operations of these four image forming portions SY, SM, SC and SK are substantially the same except that the colors of toners used in a developing step (described later) are different from each other. Accordingly, in the following, in the case where particular distinction is not required, suffixes Y, M, C and K for representing elements for associated colors are omitted, and the elements will be collectively described.

The image forming portion S includes a photosensitive drum 1 which is a rotatable drum-shaped electrophotographic photosensitive member as a first image bearing member. The photosensitive drum 1 is rotationally driven in an arrow R1 direction. At a periphery of the photosensitive drum 1 of the image forming portion S, along a rotational direction of the photosensitive drum 1, the following process devices are provided in the listed order. First, a charger 2 as a charging means is disposed. Next, an exposure device (laser scanner) 3 as an exposure means is disposed. Next, a developing device 4 as a developing means is disposed. Next, primary transfer rollers 5 which are roller-shaped primary transfer members as primary transfer means are disposed. Next, a drum cleaning device 6 as a photosensitive member cleaning means is disposed.

A surface of the rotating photosensitive drum 1 is electrically charged substantially uniformly to a predetermined polarity (negative in this embodiment) and a predetermined potential by the charger. The charged photosensitive drum 1 is exposed to light depending on image information by the exposure device 3, so that an electrostatic latent image (electrostatic image) depending on the image information is formed on the photosensitive drum 1. The electrostatic latent image formed on the photosensitive drum 1 is developed (visualized) with the toner as a developer by the developing device 4, so that the toner image is formed on the photosensitive drum 1. In this embodiment, a reverse developing method is used. That is, the toner charged to the same polarity as a charge polarity of the photosensitive drum 1 is deposited on an exposed portion of the photosensitive drum 1 where an absolute value of the potential is lowered by exposing to light the surface of the photosensitive drum 1 after the photosensitive drum 1 is uniformly charged.

Incidentally, the electrostatic latent image formed by the exposure device 3 is a group of small dotted images, and by changing a density of the dotted images, it is possible to change a density of the toner image to be formed on the photosensitive drum 1. In this embodiment, each of the color toner images is about 1.5-1.7 in maximum density, and is about 0.4-0.6 mg/cm$^2$ in toner amount per unit area at the maximum density.

As a second image bearing member, an intermediary transfer belt 7 constituted by a rotatable endless belt is provided in contact with the surfaces of the photosensitive drums 1Y, 1M, 1C, 1K of the image forming portions SY, SM, SC, SK. The intermediary transfer belt 7 is stretched by a plurality of stretching rollers (supporting members) including a tension roller 71, a driving roller 72, and a secondary transfer opposite roller 73. The tension roller 71 controls the tension of the intermediary transfer belt 7 at a constant level. The driving roller 72 transmits a driving force from a driving motor (not shown) as a driving means to the intermediary transfer belt 7 and thus moves (rotates) the intermediary transfer belt 7. The intermediary transfer belt 7 is rotationally driven by the driving roller 72 in an arrow R1 direction in FIG. 1. In this embodiment, a peripheral speed of the intermediary transfer belt is 250-300 mm/sec. The secondary transfer opposite roller 73 opposes a secondary transfer roller 82 (described later) via the intermediary transfer belt 7 and a secondary transfer belt 81 (described later), so that a secondary transfer portion (secondary transfer nip) N2 is formed.

As the intermediary transfer belt 7, a belt prepared by incorporating carbon black as an antistatic agent in an appropriate amount into a resin material such as polyimide or polycarbonate, or various rubbers may suitably be used, for example. The intermediary transfer belt 7 may preferably have a volume resistivity of about $1\times10^{9}$-$1\times10^{14}$ Ω.cm and a thickness of about 0.07-0.1 mm.

In the inner peripheral surface (back surface) side of the intermediary transfer belt 7, the above-described primary transfer rollers 5Y, 5M, 5C, 5K are disposed corresponding to the photosensitive drums 1Y, 1M, 1C, 1K, respectively. Each primary transfer roller 5 is urged toward an associated photosensitive drum 1 via the intermediary transfer belt 7, so that a primary transfer portion (primary transfer nip) N1 where the intermediary transfer belt 7 and the photosensitive drum 1 contact each other is formed. Further, in the outer peripheral surface (front surface) side of the intermediary transfer belt 7, at a position opposing the secondary transfer opposite roller, a secondary transfer device 11 as a secondary transfer means is provided. The secondary transfer device 11 includes the secondary transfer belt 81 as a transfer material feeding member constituted by an endless belt and includes the secondary transfer roller 82 as a secondary transfer member disposed on the inner peripheral surface side of the secondary transfer belt 81. The secondary transfer roller 82 is urged toward the secondary transfer opposite roller 73 via the intermediary transfer belt 7 and the secondary transfer belt 81, so that the secondary transfer portion (secondary transfer nip) N2 where the intermediary transfer belt 7 and the secondary transfer belt 81 contact each other is formed. The secondary transfer device is an example of a belt feeding device including an endless belt stretched by a plurality of stretching rollers. The secondary transfer device 8 will be specifically described later. Further, in the outer peripheral surface side of the intermediary transfer belt 7, at a position opposing the driving roller 72, an intermediary transfer belt cleaner 74 as an intermediary transfer member cleaning means is provided.

The toner image formed on the photosensitive drum 1 as described above is electrostatically transferred (primary-transferred) onto the rotating intermediary transfer belt 7 by the action of the primary transfer roller 5 at the primary transfer portion N1. At this time, to the primary transfer roller 5, a primary transfer bias (primary transfer voltage) of an opposite polarity (positive in this embodiment) to a normal charge polarity of the toner is applied. As a result, a primary transfer current is supplied to the primary transfer portion N1. For example, during full-color image formation, the respective color toner images formed on the photosensitive drums 1Y, 1M, 1C, 1K are successively transferred superposedly onto the intermediary transfer belt 7 at the respective primary transfer portions N1. As a result, multiple toner images, for a full-color image, obtained by the superposed four color toner images are formed on the intermediary transfer belt 7. A deposited matter such as the toners (primary-transfer residual toners) remaining on the photosensitive drums 1 after the predetermined transfer step is removed and collected from the photosensitive drums 1 by the drum cleaners 6.

The toner images formed on the intermediary transfer belt 7 are sent to the secondary transfer portion N2 by rotation of the intermediary transfer belt 7. On the other hand, the transfer material (recording material) P, such as paper, accommodated in a transfer material cassette (not shown) is fed one by one by a feeding roller (not shown) and then is fed to the secondary transfer portion N2 by a registration roller pair 12. The registration roller pair 12 once stops the fed transfer material P and then supplies the transfer material P to the secondary transfer portion N2 in synchronism with the feeding of the toner images on the intermediary transfer belt 7 to the secondary transfer portion N2. With respect to the feeding direction of the transfer material P, on a side upstream of the secondary transfer portion N2, the following guiding members 13*a* and 13*b* for regulating a feeding path of the transfer material P are provided. First, on the front surface side of the intermediary transfer belt 7, a secondary transfer upstream upper guiding member 13*a* as a feeding guide for regulating behavior such that the transfer material P approaches the surface of the intermediary transfer belt 7 is disposed. Further, a secondary transfer upstream lower guiding member 13*b* for regulating behavior such that the transfer material P is spaced from the surface of the intermediary transfer belt 7 is disposed. The transfer material P passes through between these guiding members 13*a* and 13*b*. That is, by these guiding members 13*a* and 13*b*, a feeding path of the transfer material P from the registration roller pair 12 to the secondary transfer portion N2 is regulated.

Then, at the secondary transfer portion N2, the toner images on the intermediary transfer belt 7 are electrostatically transferred (secondary-transferred) onto the transfer material P, sandwiched and fed between the intermediary transfer belt 7 and the secondary transfer belt 81, by the action of the secondary transfer device 11. At this time, to the secondary transfer roller 82, a secondary transfer bias (secondary transfer voltage) of an opposite polarity (positive in this embodiment) to the normal charge polarity of the toner is applied. As a result, a secondary transfer current is supplied to the secondary transfer portion N2. A deposited matter such as the toners (secondary-transfer residual toners) remaining on the intermediary transfer belt 7 after the secondary transfer step is removed and collected from the intermediary transfer belt 7 by the intermediary transfer belt cleaner 74.

The transfer material P on which the toner images are transferred is separated from the intermediary transfer belt 7 and then from the secondary transfer belt 81, and thereafter is fed to a fixing device 15 by a pre-fixing feeding device 14. Then, after unfixed toner images are fixed on the transfer material P by the fixing device 15, the transfer material P is discharged (outputted) to an outside of an apparatus main assembly of the image forming apparatus 100.

2. Secondary Transfer Device

Next, a basic structure of the secondary transfer device 11 in this embodiment will be specifically described. With regard to an outer diameter of each of the stretching rollers for the endless belt, a central portion, an end portion (end portions) and an entire region (area) refers to those of a belt stretching region (where the belt is wound around the rollers) with respect to a rotational axis direction (longitudinal direction) of each stretching roller.

The secondary transfer device 11 is constituted by a belt unit 8, a cleaning unit 9 and a toner collecting unit 10.

First, the belt unit 8 will be described. The belt unit 8 includes the secondary transfer belt 81 constituted by the endless belt. The secondary transfer belt 81 is stretched by a plurality of stretching rollers (supporting members) including the secondary transfer roller 82, a separation roller 83, a tension roller 84 and a driving roller 85. The secondary transfer roller 82 sandwiches the intermediary transfer belt 7 and the secondary transfer belt 81 between itself and the secondary transfer opposite roller 73, so that the secondary transfer portion N2 is formed. The separation roller 83 separates the transfer material P, after passing through the secondary transfer portion N2, from the secondary transfer belt 81. The tension roller 84 is urged from the inner peripheral surface side toward the outer peripheral surface side of the secondary transfer belt 81 by a spring (not shown) as an urging means, so that a tension is imparted to the secondary transfer belt 81. The driving roller 85 transmits a driving force from a driving motor (not shown) as a driving means to the secondary transfer belt 81 and thus moves (rotates) the secondary transfer belt 81. The secondary transfer belt 81 is rotationally driven in an arrow R3 direction in FIG. 1 by the driving roller 85. Further, the belt unit 8 includes an opposing roller 86 as an opposing member to an upstream fur brush 91 (described later), and the secondary transfer belt 81 is also stretched by this opposing roller 86. However, for convenience, the opposing roller 86 is not included in the plurality of stretching rollers for stretching the secondary transfer belt 81.

The respective rollers are disposed along a rotational direction of the secondary transfer belt 81 in the order of the secondary transfer roller 82, the separation roller 83, the tension roller 84, the opposing roller 86 and the driving roller 85. Each of the secondary transfer roller 82, the separation roller 83, the tension roller 84 and the opposing roller 86 is rotated with rotation of the secondary transfer belt 81. In this embodiment, the belt unit 8 is detachably mountable to the secondary transfer device 11.

In this embodiment, as the secondary transfer belt 81, a belt prepared by incorporating carbon black as an antistatic agent in an appropriate amount into a resin material, such as polyimide or polycarbonate, or the like belt is used. The secondary transfer belt 81 is about $1\times10^{9}$-$1\times10^{10}$ Ω.cm in volume resistivity and about 0.07-0.1 mm in thickness. Further, the secondary transfer belt 81 used in this embodiment is about 100 MPa or more and 10 GPa or less in Young's modulus as measured by a tensile test method (JIS K 6301), and thus is sufficiently hard.

In this embodiment, the secondary transfer roller 82 is constituted by providing, on a core metal (core material), an elastic layer formed with an ion-conductive foamed rubber (NBR rubber). This secondary transfer roller 82 is 24 mm in outer diameter, 6.0-12.0 μm in surface roughness Rz of the surface layer, and $1\times10^{5}$-$1\times10^{7}$ Ω in electric resistance as measured under application of a voltage of 2 kV in an N/N (23° C./50% RH) environment. The elastic layer is 30-40 degrees in Asker-C hardness. The secondary transfer roller 82 has a straight shape having substantially the same outer diameter in the entire region thereof with respect to the rotational axis direction thereof. Further, to the secondary transfer roller 82, a secondary transfer bias voltage source (high-voltage source) 87 as a secondary transfer bias applying means is connected. The secondary transfer bias voltage source 87 is capable of supplying a variable bias and is constituted so that a desired secondary transfer bias can be applied to the secondary transfer roller 82. By applying the secondary transfer bias to the secondary transfer roller 82, not only the toner images are transferred from the intermediary transfer belt 7 onto the transfer material P fed to the secondary transfer portion, but also the transfer material P is attracted to the secondary transfer belt 81 by a supplied electrostatic force. In this embodiment, the secondary transfer bias is applied to the secondary transfer roller 82 so that a current of, e.g., +40 to +60 μA flows.

The secondary transfer belt 81 wound around the surface of the secondary transfer roller 82 is moved in the arrow R3 direction in FIG. 1, so that the transfer material P attracted to the surface of the secondary transfer belt 81 at the secondary transfer portion N2 is fed to a downstream side.

Then, at a time when the transfer material P on the secondary transfer belt 81 reaches a position of the separation roller 83 disposed adjacent to and downstream of the secondary transfer roller 82 with respect to the rotational direction of the secondary transfer belt 81, the transfer material P is separated from the surface of the secondary transfer belt 81 by curvature of the separation roller 83. Then, the transfer material P separated from the secondary transfer belt 81 is fed to the fixing device 15 as described above.

In this embodiment, each of the separation roller 83 and the tension roller 84 is a crown roller having a crown shape such that an outer diameter is different between a central portion and end portions with respect to the rotational axis direction thereof. Each of the opposing roller 86 and the driving roller 85 has a straight shape having substantially same outer diameter in the entire region with respect to the rotational axis direction thereof. The separation roller 83, the tension roller 84, the opposing roller 86 and the driving roller 85 will be specifically described later.

Next, the cleaning unit 9 will be described. Onto the secondary transfer belt 81 which is an object-to-be-cleaned of the cleaning unit 9, the following toners are transferred. The toners include a fog toner in a sheet interval between images during continuous image formation, a toner for an adjusting toner image such as a density patch, a toner for a toner image which was formed on the intermediary transfer belt 7 during (paper) jamming, and the like toner. A deposited matter such as the toner causes back surface contamination of the transfer material P, and therefore, it is desired that the deposited matter is removed from the secondary transfer belt 81. For that reason, in this embodiment, in the secondary transfer device 11, the cleaning unit 9 using an electrostatic fur brush cleaning type is provided.

The cleaning unit 9 includes an upstream fur brush roller (upstream fur brush) 91 and a downstream fur brush roller (downstream fur brush) 94 which are rotatable roller-shaped fur brushes as a cleaning member. With respect to the rotational direction, the upstream fur brush 91 is disposed at an upstream side and the downstream fur brush 94 is disposed at a downstream side. Specifically, the upstream fur brush 91 is disposed at a position downstream of the tension roller 84 and upstream of the driving roller 85 with respect to the rotational direction of the secondary transfer belt 81 so as to contact the outer peripheral surface (front surface) of the secondary transfer belt 81. At a position opposing the upstream fur brush 91 via the secondary transfer belt 81, the opposing roller 86 as the opposing member is disposed in contact with the inner peripheral surface (back surface). In this embodiment, the opposing roller 86 is constituted by a metal roller and is grounded electrically. The downstream fur brush 94 is disposed so as to contact the outer peripheral surface of the secondary transfer belt 81 wound around the driving roller 85. In this embodiment, each of the upstream fur brush 91 and the downstream fur brush 94 is constituted by planting electroconductive nylon brushes in a core material. Each of the upstream fur brush 91 and the downstream fur brush 94 is rotationally driven in an arrow direction in FIG. 1.

Further, an upstream collecting roller 92 is provided so as to be rotatable in contact with the upstream fur brush 91. The upstream collecting roller 92 not only collects the deposited matter such as the toner collected from the surface of the secondary transfer belt 81 by the upstream fur brush 91, but also functions as a bias applying member (bias roller) for applying a bias (voltage) to the upstream fur brush 91.

Similarly, a downstream collecting roller 95 is provided so as to be rotatable in contact with the downstream fur brush 94. The downstream collecting roller 95 not only collects the deposited matter such as the toner collected from the surface of the secondary transfer belt 81 by the downstream fur brush 94, but also functions as a bias applying member for applying a bias (voltage) to the downstream fur brush 94. To each of the upstream collecting roller 92 and the downstream collecting roller 95, a collecting bias voltage source (not shown) is connected. Further, to the upstream collecting roller 92, a bias (voltage) of an opposite polarity (positive in this embodiment) to a normal charge polarity of the toner is applied, and to the downstream collecting roller 95, a bias of the same polarity (negative in this embodiment) as the normal charge polarity of the toner is applied. Each of the upstream collecting roller 92 and the downstream collecting roller 95 is rotationally driven in an arrow direction in FIG. 1.

Further, an upstream cleaning blade 93 as a removing member is provided in contact with the upstream collecting roller 92. The upstream cleaning blade 93 scrapes the deposited matter such as the toner off the upstream collecting roller 92, and the deposited matter is collected in a toner collecting unit 10 (described later). Similarly, a downstream cleaning blade 96 as the removing member is provided in contact with the downstream collecting roller 95. The downstream collecting blade 96 scrapes the deposited matter such as the toner off the downstream collecting roller 95, and the deposited matter is collected in the toner collecting unit 10.

The toner transferred on the secondary transfer belt 81 is transferred from the secondary transfer belt 81 onto the upstream fur brush 91 to which the positive bias (voltage) is applied by the upstream roller 92. Then, the toner transferred on the upstream fur brush 91 is transferred onto the upstream collecting roller 92 and then is scraped off the upstream collecting roller 92 by the upstream cleaning blade 93. To the upstream collecting roller 92, the positive bias is applied, so that the toner charged to the normal charge polarity of the toner is collected from the secondary transfer belt 81 by the upstream fur brush 91. Most of the negative toner is transferred onto the upstream collecting roller 92 and is scraped off the roller 92 by the upstream cleaning blade 93. However, there is toner which is transferred from the secondary transfer belt 81 onto the upstream fur brush 91 but which passes through a contact portion between the upstream fur brush 91 and the upstream collecting roller 92 without being transferred from the upstream fur brush 91 onto the upstream collecting roller 92. This toner can be returned from the upstream fur brush 91 to the secondary transfer belt 81 when the toner contacts the secondary transfer belt 81 again. In many cases, this toner is the positive toner, and therefore, is transferred onto the downstream fur brush 94 supplied with the negative bias, by the downstream collecting roller 95. The toner is transferred from the downstream fur brush 94 onto the downstream collecting roller 95, and then is scraped off the roller 95 by the downstream cleaning blade 96.

The toner collecting unit 10 includes a fur brush member such as a screw or an auger, and feeds the toner collected by the upstream cleaning blade 93 and the downstream cleaning blade 96 as described above, to a residual (waste) toner box (container) (not shown).

3. Countermeasure Against Waving of Transfer Material

Figure 2:
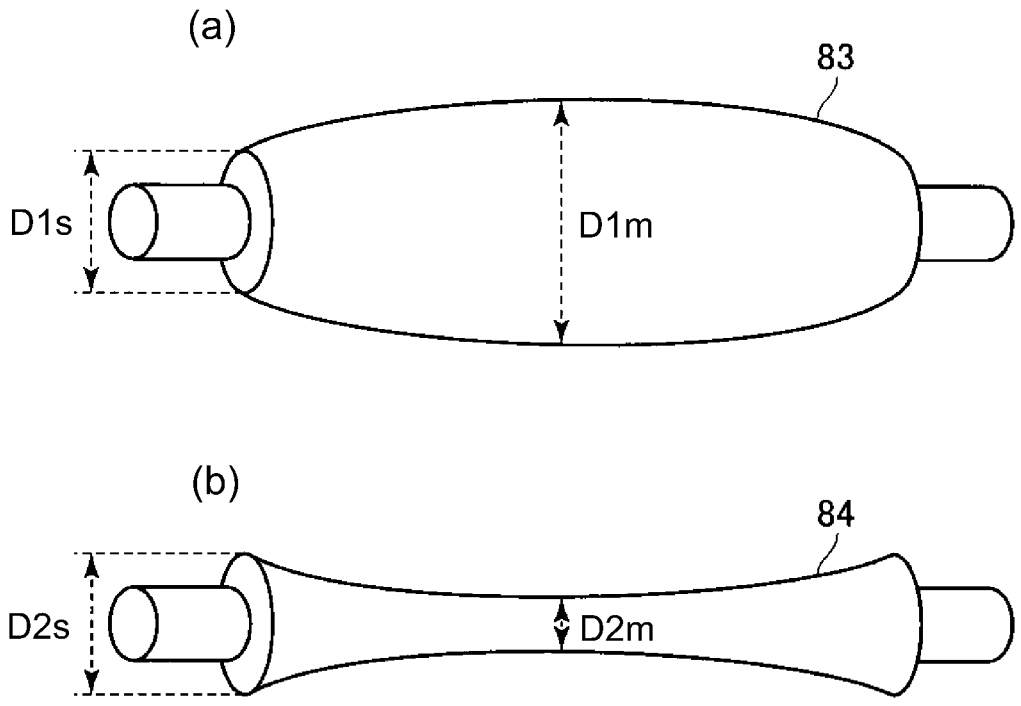
In FIG. 2, (a) and (b) are schematic views showing a separation roller and a tension roller, respectively, in Embodiment 1.

In this embodiment, as shown (a) of FIG. 2, the separation roller 83 is a normal crown roller having a normal crown shape such that an outer diameter at a central portion is larger than those at end portions with respect to the rotational axis direction thereof. This is because an image defect (improper transfer) due to waving of the transfer material P is suppressed. This will be described below.

The transfer material P as a toner image-receiving member, which is paper in general in many cases causes waving for various reasons. For example, the paper on which waving generates by the influence of the fixing process (e.g., in the case where double-sided image formation is effected), a length thereof at the secondary transfer portion T2 with respect to the feeding direction is longer at end portions than at a central portion with respect to a direction (widthwise direction) substantially perpendicular to the feeding direction in some cases.

Figure 3:
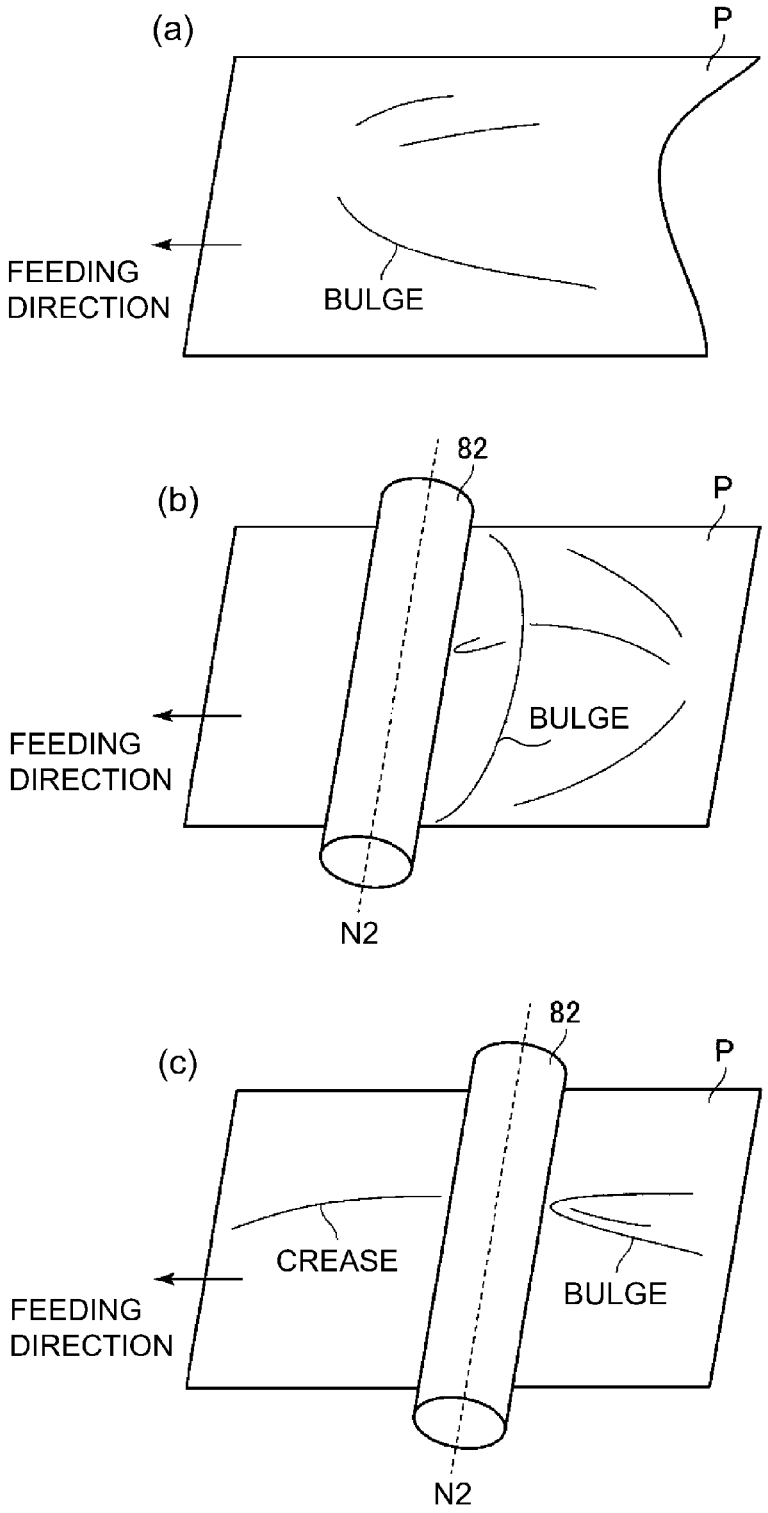
In FIG. 3, (a) to (c) are schematic views for illustrating a behavior of paper on which waving generates in the neighborhood of a transfer portion.

In FIG. 3, (a) to (c) are schematic views showing states of the paper P in the neighborhood of the secondary transfer portion N2 as seen from the secondary transfer belt 81 side in the case where the paper P on which the waving generates is fed to the secondary transfer portion N2, in which the secondary transfer belt 81 is omitted from illustration. When the wavy paper is intended to be attracted to the surface of the secondary transfer belt 81, as shown in (a) of FIG. 3, the central portion of the paper with respect to the widthwise direction bulges convexly so as to be spaced from the secondary transfer belt 81 in order to cancel the length of the paper at the end portions with respect to the widthwise direction. When the paper bulged at the central portion with respect to the widthwise direction is fed to the secondary transfer portion N2 as it is, as shown in (b) of FIG. 2, the bulge at the central portion is shifted toward the upstream side with respect to the feeding direction. When this bulge at the central portion cannot withstand the pressure of the secondary transfer portion N2, as shown in (c) of FIG. 3, the bulge is flattened by the pressure of the secondary transfer portion N2, so that a crease generates.

On the other hand, in this embodiment, the separation roller 83 disposed downstream of and adjacent to the secondary transfer roller 82 with respect to the rotational direction of the secondary transfer belt 81 is the normal crown roller as described above. Accordingly, this separation roller 83 deforms the secondary transfer belt 81 so that the central portion projects from the inner peripheral surface side toward the outer peripheral surface side (this direction is also referred to as an upward direction) in a larger degree than the end portions with respect to the direction (widthwise direction) substantially perpendicular to the rotational direction of the secondary transfer belt 81. As a result, the surface of the secondary transfer belt 81 from the secondary transfer portion N2 to the position of the separation roller 83 has such a shape that the central portion bulges upwardly.

Thus, in this embodiment, the paper is deformed convexly upwardly in a side downstream of the secondary transfer portion N2, while the paper is sandwiched at the secondary transfer portion N2 in a straight shape. In this state, on a rigid member such as the paper, a force such that the paper projects downwardly (in an opposite direction) as a reaction acts in a region from the upwardly deformed portion in the downstream side to the secondary transfer portion N2. The action of the force such that the paper projects downwardly at the secondary transfer portion N2 leads to a decrease in degree of the above-described bulge causing the crease at the secondary transfer portion N2. For this reason, the separation roller 83 is formed as the normal crown roller, so that it is possible to suppress the crease generated at the secondary transfer portion N2 on the transfer material P on which the waving generates.

On the other hand, in this embodiment, the tension roller 84 is an inverted crown roller having an inverted crown shape such that an outer diameter at a central portion is smaller than an outer diameter at end portions with respect to the rotational axis direction thereof. The tension roller 84 is a stretching roller disposed downstream of and adjacent to the separation roller 83 with respect to the rotational direction of the secondary transfer belt 81. That is, the separation roller 83 is the stretching roller (upstream roller) disposed upstream of and adjacent to the tension roller 84 with respect to the rotational direction of the secondary transfer belt 81. In this embodiment, the reason why the tension roller 84 is the inverted crown roller is that an effect of suppressing the crease of the transfer material P is improved by the separation roller 83 which is the above-described normal crown roller. This will be described below.

The effect of suppressing the crease of the transfer material P by the above-described normal crown roller is obtained in the case where the secondary transfer belt 81 feeding the transfer material P is sufficiently stretched along a shape of the normal crown roller. In the case where the secondary transfer belt 81 is formed of a relatively hard material such as a resin material, deformation of the secondary transfer belt 81 along the shape of the normal crown roller is insufficient and the crease suppressing effect is small in some cases.

On the other hand, in this embodiment, the tension roller 84 disposed downstream of and adjacent to the separation roller 83 with respect to the rotational direction of the secondary transfer belt 81 is the inverted crown roller as described above. Accordingly, the tension roller 84 deforms the secondary transfer belt 81 so as to project upwardly at its end portions more than at its central portion with respect to the widthwise direction of the secondary transfer belt 81. As a result, a force for pulling the secondary transfer belt 81 outwardly with respect to the widthwise direction acts on the secondary transfer belt 81 from a position of the separation roller 83 to a position of the tension roller 84. For that reason, even in the case where the secondary transfer belt 81 is formed of the relatively hard material as described above, it is possible to stretch the secondary transfer belt 81 by the separation roller 83 so that the secondary transfer belt 81 projects upwardly at the central portion more than at the end portions with respect to the widthwise direction.

Further, in this embodiment, with respect to a crown amount of the separation roller 83, a crown amount of the tension roller 84 is set so that a peripheral length of the secondary transfer belt 81 in cross section is substantially the same in an entire region of the secondary transfer belt 81 with respect to the widthwise direction. As a result, the peripheral length of the secondary transfer belt 81 with respect to a circumferential direction is prevented from being excessive depending on a position with respect to the widthwise direction, so that flexure of the secondary transfer belt 81 can be suppressed. Here, as shown in (a) of FIG. 2, when a maximum diameter (outer diameter at a central portion with respect to the rotational axis direction) of the separation roller 83 is D1m and a minimum diameter (outer diameter at end portions with respect to the rotational axis direction) of the separation roller 83 is D1s, the crown amount of the separation roller 83 can be represented by $|D1s-D1m|/2$. Further, as shown in (b) of FIG. 2, when a minimum diameter (outer diameter at central portion with respect to the rotational axis direction) of the tension roller 83 is D2m and a maximum diameter (outer diameter at end portions with respect to the rotational axis direction) of the tension roller 84 is D2s, the crown amount of the tension roller 84 can be represented by $|D2s-D2m|/2$.

4. Crease of Secondary Transfer Belt

When the tension roller 84 is the inverted crown roller, the tension is exerted on the secondary transfer belt 81, so that a crease generates for absorbing the tension in the neighborhood of the secondary transfer portion N2 in a side downstream of the tension roller 84 with respect to the rotational direction of the secondary transfer belt 81. This crease is liable to generate so that the secondary transfer belt 81 projects from the outer peripheral surface side toward the inner peripheral surface side at the central portion more than at the end portions with respect to the widthwise direction.

As described above, the upstream fur brush 91 is disposed downstream of the tension roller 84 with respect to the rotational direction of the secondary transfer belt 81, and the opposing roller 86 is disposed opposed to this upstream fur brush 91 via the secondary transfer belt 81. For this reason, as described above, when the crease is generated on the secondary transfer belt 81 by the tension roller 84, the crease reaches a portion where the secondary transfer belt 81 is sandwiched between the upstream fur brush 91 and the opposing roller 86.

In the electrostatic fur brush cleaning type, removal of the toner on the belt is made by scraping (rubbing) the surface (cleaning surface) of the belt with the fur brush. In this embodiment, a preferred entering amount of the upstream fur brush 91 into the secondary transfer belt 81 is about 1.5±0.3 mm. The entering amount of the fur brush into the belt can be represented by a distance between a free end of the fur brush at a belt side and the surface of the belt with respect to a normal direction of the belt assuming that the fur brush is not deformed by the belt. The opposing roller 86 not only stabilizes the entering amount of the upstream fur brush 91 into the secondary transfer belt 81 but also functions as an opposing electrode to the upstream fur brush 91. A preferred value of the entering amount varies also depending on a set value of the bias (voltage) applied to the upstream fur brush 91 and therefore is not limited to the above-described value. At this time, in the case where a height of the crease generated on the secondary transfer belt 81 is high to a certain extent or more, the crease height exceeds a latitude of the height at which the upstream fur brush 91 can exhibit a sufficient cleaning performance, so that improper cleaning generates in some cases. The crease height can be represented by a distance between a position of an outermost peripheral surface of the belt and a position of an innermost peripheral surface of the belt with respect to the normal direction.

Therefore, in this embodiment, the entering amount of the opposing roller 86 into the secondary transfer belt 81 is set so that the improper cleaning can be sufficiently suppressed by reducing a degree of the crease on the cleaning surface.

5. Countermeasure Against Crease

Setting of the entering amount of the opposing roller 86 into the intermediary transfer belt 81 will be described.

Figure 4:
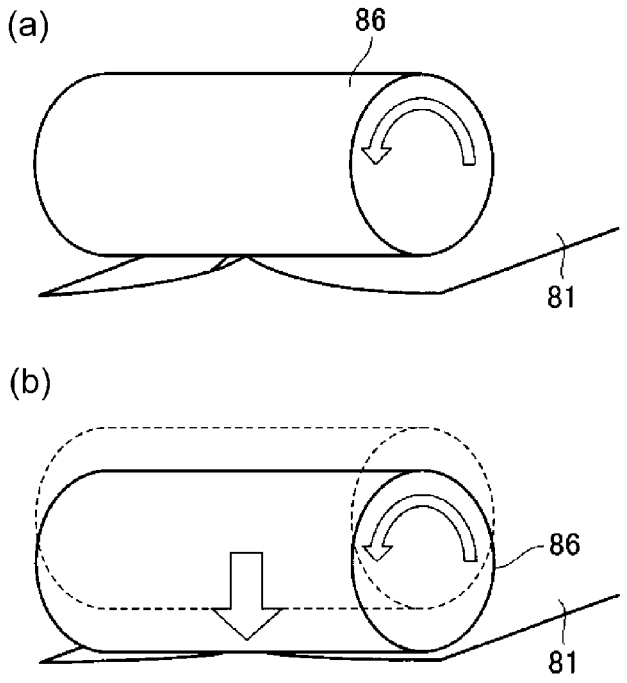
In FIG. 4, (a) and (b) are schematic views showing a state in which a degree of a crease on a cleaning surface is reduced.

The opposing roller 86 is provided so that a tension surface between the tension roller 84 and the driving roller 85 in the case where the opposing roller 86 is not provided is projected from the inner peripheral surface side toward the outer peripheral surface side. This state is a state in which the opposing roller 86 enters the secondary transfer belt 81. The driving roller 85 is the stretching roller (downstream roller), of the plurality of stretching rollers, disposed downstream of and adjacent to the tension roller (inverted crown roller) 84 with respect to the rotational direction of the secondary transfer belt 81. FIG. 4 schematically shows a state in which the opposing roller 86 is caused to enter the secondary transfer belt 81 and thus the crease of the cleaning surface is reduced. The crease generated on the cleaning surface as shown in (a) of FIG. 4 can be reduced by stretching the secondary transfer belt 81 in a more flat state through entrance of the opposing roller 86 into the secondary transfer belt 81 as shown in (b) of FIG. 4. As described above, the crease of the cleaning surface generates due to the inverted crown shape of the tension roller 84 which is the inverted crown roller. Therefore, in this embodiment, the entering amount of the opposing roller 86 into the secondary transfer belt 81 is set depending on the crown amount of the tension roller 84. This will be specifically described.

Figure 5:
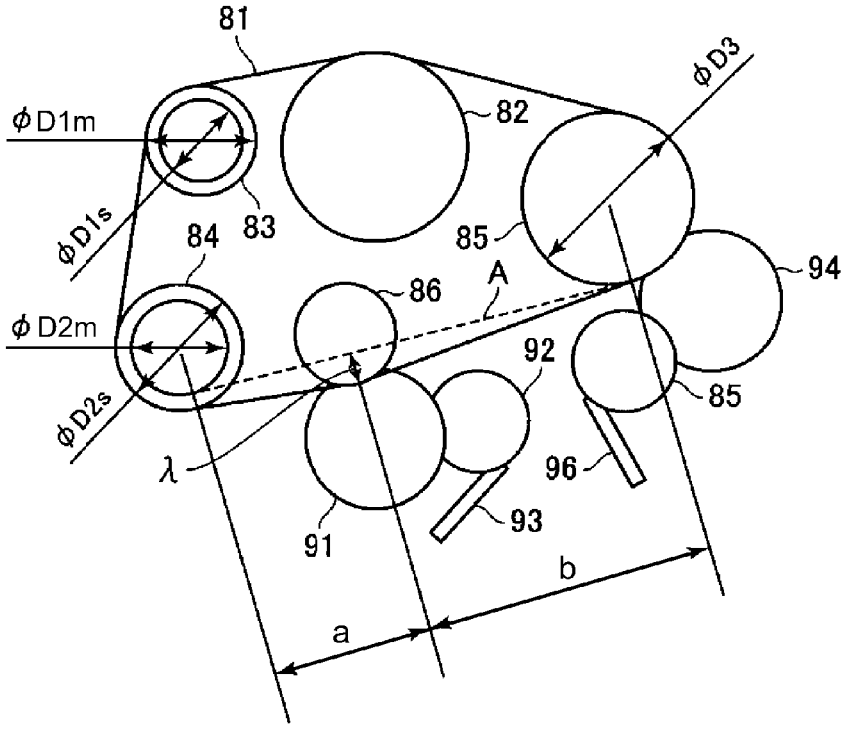
FIG. 5 is view showing a positional relation among respective portions of a belt unit in Embodiment 1.

Here, with reference to FIG. 5, various parameters in the secondary transfer device 11 will be described. FIG. 5 is a schematic view showing a positional relation among the respective portions of the secondary transfer device 11. As described above, the maximum diameter (outer diameter at the central portion with respect to the rotational axis direction) of the separation roller 83 is D1m and the minimum diameter (outer diameter at the end portions with respect to the rotational axis direction) of the separation roller 83 is D1s. Further, as described above, the minimum diameter (outer diameter at the central portion with respect to the rotational axis direction) of the tension roller 84 is D2m and the maximum diameter (outer diameter at the end portions with respect to the rotational axis direction) of the tension roller 84 is D2s. Further, an outer diameter (at a position corresponding to a minimum diameter position of the tension roller 84 with respect to the rotational axis direction) of the driving roller 85 is D3. Further, as seen in the rotational axis direction of the tension roller 84, an outer common tangential line between the tension roller 84 at the position of the minimum diameter D2m and the driving roller 85 at the position of the outer diameter D3 is a reference line A. Further, a maximum distance in which the opposing roller 86 is caused to enter the secondary transfer belt 81 from the inner peripheral surface side toward the outer peripheral surface side in a direction perpendicular to the reference line A through the reference line A is an entering amount λ. Further, as seen in the rotational axis direction of the tension roller 84, a distance along the reference line A between a line which passes through a rotation center of the tension roller 84 and which is perpendicular to the reference line A and a line which passes through a rotation center of the opposing roller 86 at the position of the entering amount λ and which is perpendicular to the reference line A is a. Further, as seen in the rotational axis direction of the tension roller 84, a distance along the reference line A between the line which passes through the rotation center of the opposing roller 86 at the position of the entering amount λ and which is perpendicular to the reference line A and a line which passes through a rotation center of the driving roller 85 and which is perpendicular to the reference line A is b.

Figure 6:
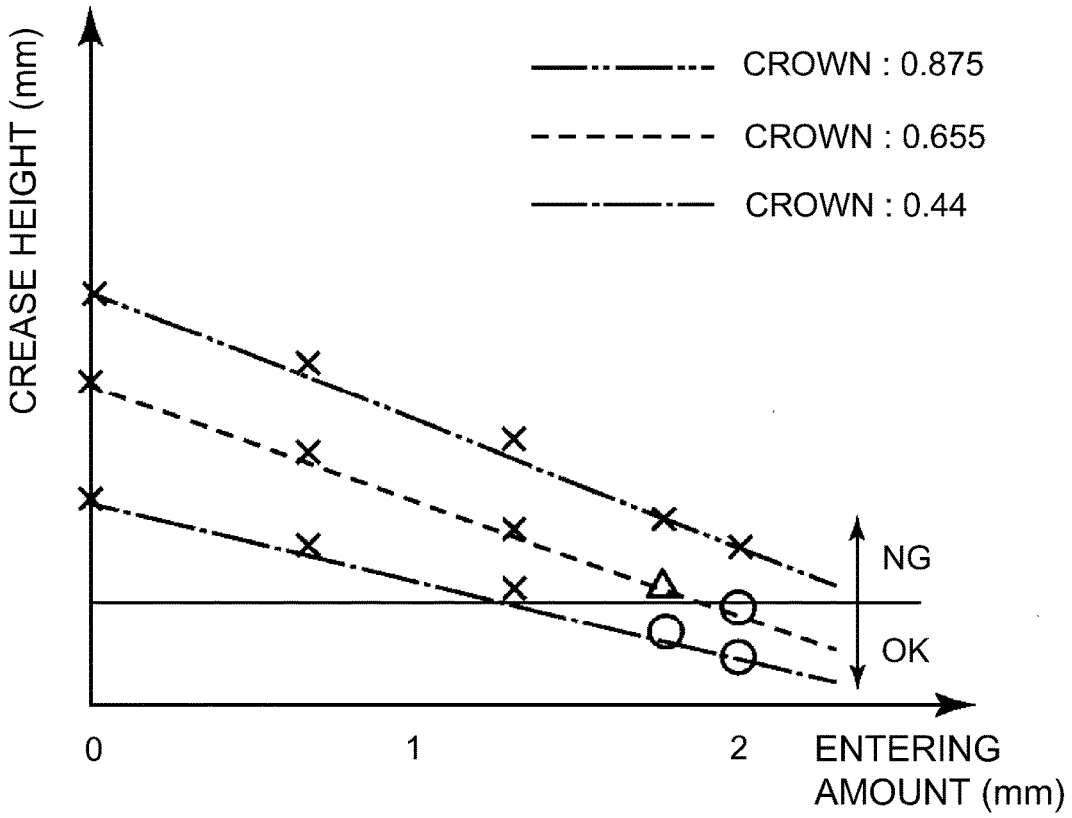
FIG. 6 is a graph showing a relationship between an entering amount of an opposing roller and a crease height when a crown amount is changed.

FIG. 6 shows an example of a relationship among the entering amount λ of the opposing roller 86 into the secondary transfer belt 81, the crown amount of the tension roller 84 and the crease height of the cleaning surface. From FIG. 6, it is understood that the crease height is higher with an increasing crown amount of the tension roller 84. This is because the outer diameter of the normal crown roller varies depending on the position with respect to the rotational axis direction, and therefore, also the secondary transfer belt 81 would vary along the inverted crown shape correspondingly to a difference in outer diameter due to the position of the inverted crown roller being bent and thus the crease height of the cleaning surface becomes high.

Further, from FIG. 6, it is understood that there is a tendency that the crease height of the cleaning surface is lower with an increasing entering amount λ of the opposing roller 86 into the secondary transfer belt 81. This is because the crease of the cleaning surface can be smoothed down as shown in FIG. 4 by increasing the entering amount λ of the opposing roller 86 into the secondary transfer belt 81. This effect is larger with an increasing entering amount λ of the opposing roller 86 into the secondary transfer belt 81, and when the entering amount λ is increased, there is a tendency that the crease height of the cleaning surface becomes linearly small. When the entering amount λ is further increased, the crease height of the cleaning surface approaches 0 without limit.

From the above-described tendency, when the entering amount λ of the opposing roller 86 into the secondary transfer belt 81 is increased to the possible extent, it is possible to decrease the crease height of the cleaning surface to the possible extent. However, when the entering amount λ is excessively increased, inconveniences such that the image forming apparatus is upsized and that a slip of the secondary transfer belt 81 at the inner peripheral surface is liable to generate by a decrease in winding amount of the secondary transfer belt 81 about the driving roller 85 generate in some cases. For that reason, the entering amount λ of the opposing roller 86 into the secondary transfer belt 81 is desired to be as small an extent as possible within a range of sufficiently reducing a degree of the crease of the cleaning surface.

Figure 7:
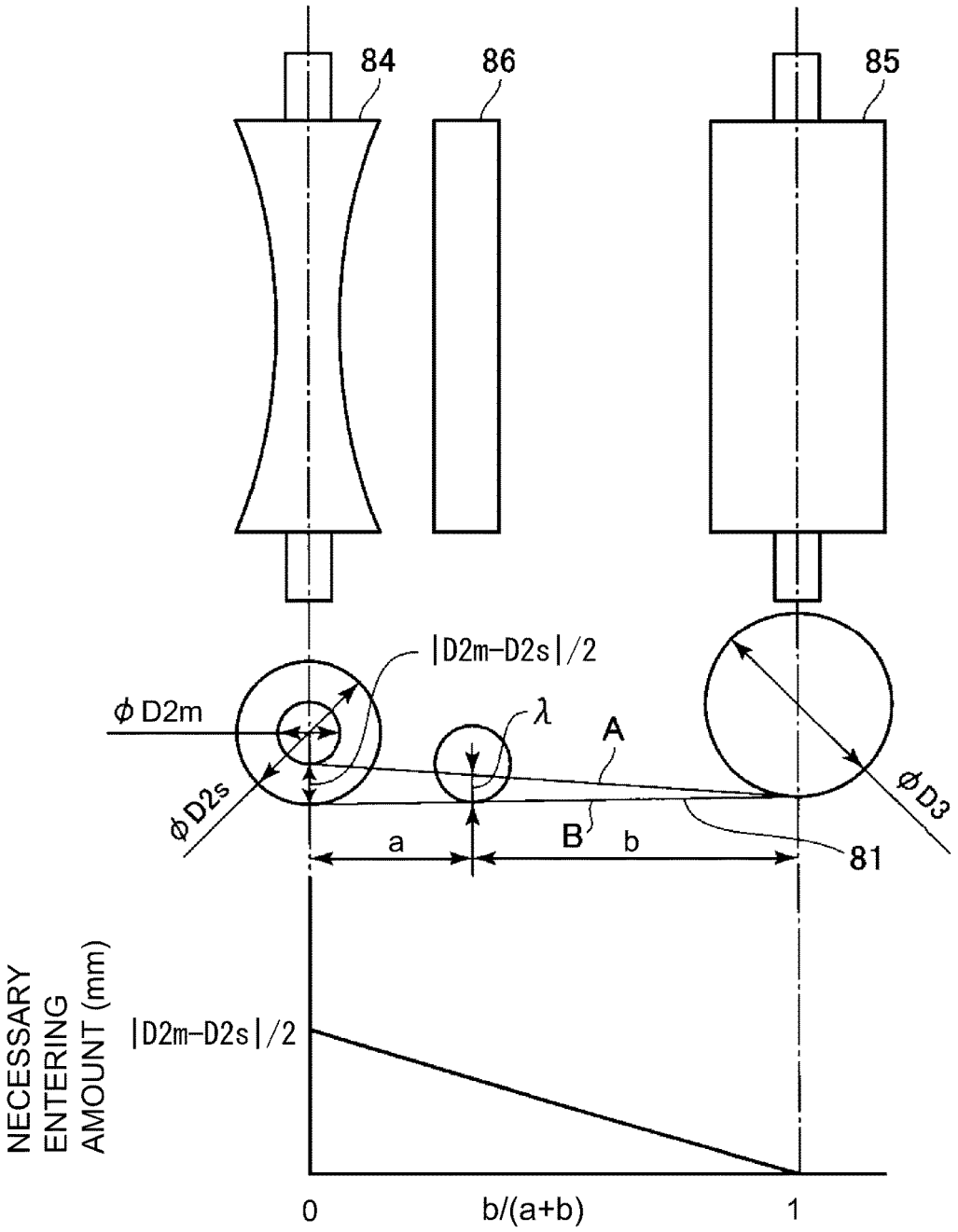
FIG. 7 is a schematic view for illustrating a relationship between a position of the opposing roller and the entering amount of the opposing roller.

Further, also depending on the position of the opposing roller 86, the entering amount λ of the opposing roller 86 into the secondary transfer belt 81 necessary to reduce the degree of the crease of the cleaning surface varies. FIG. 7 is a schematic view for illustrating a necessary entering amount λ varying depending on the position of the opposing roller 86. As shown in FIG. 7, on the tension roller 84, a degree of the winding of the secondary transfer belt 81 about the inverted crown shape of the tension roller 84 is different between the widthwise end portion and the widthwise central portion. For that reason, on the tension roller 84, a difference in height of the surface of the secondary transfer belt 81 depending on the widthwise position of the secondary transfer belt 81 is large. As described above, this difference in height varies depending on the crown amount of the tension roller 84, so that the height difference becomes larger with an increasing crown amount. On the other hand, the driving roller 85 has a straight shape, so that the height difference of the secondary transfer roller 81 on the driving roller 85 with respect to the widthwise direction is substantially 0. As a result, the secondary transfer belt 81 wound around the tension roller 84 and the driving roller 85 is different in feeding path depending on the position thereof with respect to the widthwise direction.

Here, an outer common tangential line between the tension roller 84 at the position of the maximum diameter D2s and the driving roller 85 having the outer diameter D3 as seen in the rotational axis direction of the tension roller 84 is a phantom line B. In this case, a distance between the reference line A and the phantom line B with respect to an entrance direction of the opposing roller 86 into the secondary transfer belt 81 linearly becomes smaller with a decreasing distance from the opposing roller 86 toward the driving roller 85. For that reason, also the entering amount λ of the tension roller 84 necessary to reduce the degree of the opposing roller so as to compensate for the difference in height of the surface of the secondary transfer belt 81 linearly becomes smaller as the position of the opposing roller 86 approaches the driving roller 85 from the tension roller 84 along the reference line A. Accordingly, with an increasing value of b/(a+b) which is ratio (between the stretching rollers) of the distance b to the sum of the distance a and the distance b, also the entering amount λ of the opposing roller 86 into the secondary transfer belt 81 necessary to sufficiently reduce the degree of the crease becomes larger.

As described above, the entering amount λ of the opposing roller 86 into the secondary transfer belt 81 necessary to sufficiently reduce the degree of the crease becomes larger with an increasing ratio of b/(a+b) between the stretching rollers on the basis of |D2m−D2s|/2. Therefore, in this embodiment, the entering amount λ of the opposing roller 86 into the secondary transfer belt 81 is set so as to satisfy the following formula (1):

$$\lambda \geq (|D2s-D2m|/2)\times(b/(a+b)) \quad (1).$$

As a result, the crease height of the cleaning surface is sufficiently decreased, so that it is possible to suppress a lowering in cleaning performance of the upstream fur brush 91.

Specifically, in this embodiment, the tension roller 84 is 17.2 mm in maximum diameter D2s and 16 mm in minimum diameter D2m. Further, the distance a from the tension roller 84 to the opposing roller is 21.2 mm, and the distance b from the opposing roller 86 to the driving roller 85 is 37.6 mm. Accordingly, in this embodiment, from the rotational axis direction formula (1), $$\lambda \geq (|D2s-D2m|/2)\times(b/(a+b))=1.2/2\times(37.6/58.8)=0.4.$$

Accordingly, in this embodiment, when the entering amount λ is 0.4 mm or more, the crease height of the secondary transfer belt 81 at the nip (cleaning surface) between the upstream fur brush 91 and the opposing roller 86 can be sufficiently lowered. As a result, the cleaning performance of the upstream fur brush 91 is ensured, so that the improper cleaning can be suppressed.

Thus, in this embodiment, setting of a lower limit of the entering amount λ of the opposing roller 86 necessary to sufficiently reduce the degree of the crease of the cleaning surface is facilitated. As described above, as regards an upper limit of the entering amount λ of the opposing roller 86 into the secondary transfer belt 81, this value can be appropriately set within a range in which the inconveniences such as the upsizing of the image forming apparatus and the generation of the slip (slide) of the driving roller 85 do not generate. As shown in FIG. 7, it would be considered that the difference in height of the surface of the secondary transfer belt 81 with respect to the widthwise direction becomes maximum on the opposing roller 86, and therefore, typically the entering amount λ may be not more than |D2s−D2m|/2. In order to reduce the degree of the crease of the cleaning surface with high reliability, it is also possible to increase the entering amount λ, but the entering amount λ of not more than about 10 times, preferably not more than about 5 times, |D2s−D2m|/2 can be an index thereof.

As described above, according to this embodiment, by appropriately setting the entering amount λ of the opposing roller 86 into the secondary transfer belt 81, even when the upstream fur brush 91 is disposed on the crease generating surface of the secondary transfer belt 81, the generation of the improper cleaning can be suppressed. Thus, according to this embodiment, in a constitution using the crown roller as the stretching roller for stretching the endless belt, it is possible to suppress a lowering in belt cleaning performance of the fur brush.

Embodiment 2

Next, another embodiment of the present invention will be described. Basic constitutions and operations of the image forming apparatus in this embodiment are the same as those in Embodiment 1. Accordingly, elements having the same or corresponding constitutions and functions are represented by the same reference numerals or symbols and will be omitted from detailed description.

In Embodiment 1, a cleaning type of the secondary transfer belt 81 in the secondary transfer device 11 is different from the cleaning type in Embodiment 1. Other constitutions of the secondary transfer device 11 are substantially the same as those in Embodiment 1. That is, the separation roller 83 is the normal crown roller, and the tension roller 84 is the inverted crown roller. Further, the driving roller 85 has the straight shape.

Figure 8:
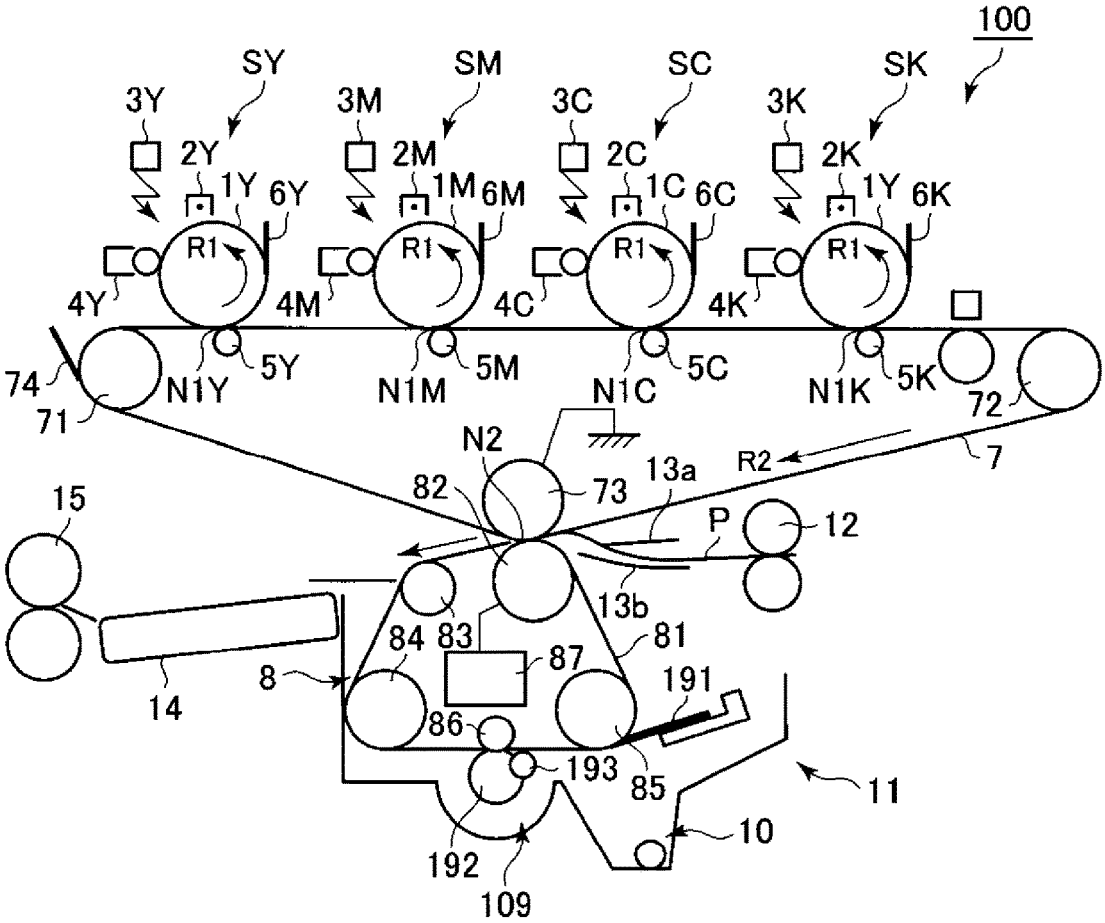
FIG. 8 is a schematic sectional view of an image forming apparatus according to Embodiment 2 of the present invention.

FIG. 8 is a schematic sectional view of an image forming apparatus 100 in this embodiment. A cleaning unit 109 of the secondary transfer device 11 in this embodiment includes a cleaning belt 191 as a cleaning member for removing the toner on the secondary transfer belt 81. The cleaning belt 191 is contacted to the secondary transfer belt 81 on the driving roller 85 having the straight shape in order to satisfactorily set a contact pressure and a contact angle with the secondary transfer belt 81.

Thus, in the case where a blade cleaning type is employed, in some cases, improper cleaning due to paper powder sandwiched at a contact portion (blade nip) between the cleaning belt 191 and the secondary transfer belt 81 generate. That is, paper cuttings fed and deposited on the paper as the transfer material P and paper powder generated by abrasion of the paper during the feeding are deposited on the secondary transfer belt 81 and fed by the secondary transfer belt 81 in some cases. Then, the paper powder (cuttings) is scraped off the secondary transfer belt 11 by the cleaning belt 191 and accumulates on the cleaning belt 191, so that a blade nip is non-uniform and the toner passes through the blade nip and thus the improper cleaning generates in some cases.

Therefore, in this embodiment, in order to prevent the paper powder from being sandwiched in the blade nip, the scraping-off of the paper powder by a fur brush 192 is effected at a side upstream of the blade nip with respect to the rotational direction of the secondary transfer belt 81. The fur brush 192 is constituted similarly as in the fur brush 91 in Embodiment 1, and a bias is applied thereto by a collect roller 193. Further, in removal of the paper powder by the fur brush 192, in order to stabilize an entering amount of the fur brush 192 into the secondary transfer belt 81, the opposing roller 86 is disposed at a position to contact the fur brush 192 via the secondary transfer belt 81.

In such a constitution, in this embodiment, the entering amount λ of the opposing roller 86 into the secondary transfer belt 81 is, similarly as in Embodiment 1, set so as to satisfy the following formula (1):

$$\lambda \geq (|D2s-D2m|/2)\times(b/(a+b)) \quad (1).$$

That is, similarly as in Embodiment 1, the degree of the crease of the surface (cleaning surface) on which the paper powder is removed from the secondary transfer belt 81 by the fur brush 192 is reduced, so that the fur brush 192 can be contacted to the secondary transfer belt 81 uniformly. As a result, the fur brush 192 can stably remove the paper powder, and therefore, it is possible to suppress the improper cleaning generated by the paper powder sandwiched in the blade nip.

As described above, also in this embodiment, similarly as in Embodiment 1, in the constitution in which the crown roller is used as the stretching roller for stretching the endless belt, it is possible to suppress the lowering in belt cleaning performance by the fur brush.

OTHER EMBODIMENTS

The present invention was described above based on specific embodiments, but is not limited thereto.

In the above-described embodiments, the opposing member to the fur brush was described as the rotatable roller, but is not limited thereto. For example, the opposing member may also be a member which is fixedly disposed at the rotating belt and which rubs against the inner peripheral surface of the belt. The opposing member can be any of those having a plate shape, a sheet shape, a pad shape, a fixedly disposed roller shape, and the like shape.

Further, in the above-described embodiments, the fur brush was described as the fur brush roller having the roller shape, but is not limited thereto. For example, the fur brush may also be a fur brush which is fixedly disposed at the rotating belt and which rubs against the outer peripheral surface of the belt. The fur brush can be any of those having a fixedly disposed deck (scrub) brush shape and a fixedly disposed roller shape. Further, also in the case where the fur brush is rotatable, a rotational direction of the fur brush is not limited to that in the above-described embodiments, but the fur brush may also be rotated in the same direction as or in an opposite direction to the movement direction of the belt at a contact portion with the belt.

Further, in Embodiment 1, the two fur brushes consisting of the fur brush disposed in contact with the belt stretching surface between the crown roller and the stretching roller disposed immediately downstream of the crown roller in the case where there is no opposing member and the fur brush disposed in contact with the belt on the stretching roller were provided. However, the present invention is not limited to the constitution. The above-described formula (1) may only be required to be satisfied with regard to at least one fur brush disposed in contact with the belt stretching surface between the crown roller and the stretching roller disposed immediately downstream of the crown roller. A plurality of fur brushes contacting the belt stretching surface between the crown roller and the stretching roller disposed immediately downstream of the crown roller may also be provided. In that case, of the plurality of fur brushes, when at least one fur brush (typically the upstream most fur brush with respect to the rotational direction of the belt) is disposed so as to satisfy the above-described formula (1), a corresponding effect is obtained. Each of the plurality of fur brushes may also be disposed so as to satisfy the above-described formula (1).

Further, in the above-described embodiments, the case where the belt feeding device to which the present invention is applied is the secondary transfer device was described, but the belt feeding device is not limited thereto. When the belt feeding device which includes the endless belt stretched by the plurality of stretching rollers and in which the belt is cleaned by the fur brush is used, the present invention can be applied thereto, so that an effect similar to those in the above-described embodiments can be obtained. The endless belt as the member-to-be-cleaned subjected to cleaning by the fur brush may also be a transfer material carrying member (transfer material carrying belt) for carrying and feeding the transfer material onto which toner images are transferred from a plurality of image bearing members. In addition, the endless belt as the member-to-be-cleaned may also be the intermediary transfer belt, a photosensitive (member) belt, an electrostatic recording dielectric (member) belt, and the like belt.

Further, in the above-described embodiments, the case where the stretching roller immediately upstream of the opposing roller on the cleaning surface is the inverted crown roller was described, but also in the case where the stretching roller is the normal crown roller, a problem of the improper cleaning similar to that described in the above-described embodiments can arise. For example, in the above-described embodiments, it would be considered that the constitution in which the stretching roller as the separation roller 83 is the inverted crown roller and the stretching roller as the tension roller 84 is the normal crown roller is employed. Also in this constitution, the crease can generate on the belt stretching surface between the stretching roller as the tension roller 84 and the stretching roller as the driving roller 85. This crease is liable to generate in such a manner that the belt projects from the inner peripheral surface side toward the outer peripheral surface side at the widthwise central portion more than the widthwise end portions. Further, a degree of this crease can be reduced similarly as in the cases of the above-described embodiments by causing the opposing member to enter the belt. An entering amount of the opposing member at this time can be set by reading D2m and D2s (FIG. 7) as a maximum diameter (outer diameter at the central portion with respect to the rotational axis direction) and a minimum diameter (outer diameter at the end portions with respect to the rotational axis direction), respectively, of the normal crown roller.

That is, in this case, the maximum diameter of the normal crown roller is D2m and the minimum diameter of the normal crown roller is D2s. Further, an outer diameter (outer diameter at a position corresponding to a position of the minimum diameter) of the stretching roller (downstream roller) corresponding to the driving roller 85 is D3. Further, similarly as in the above-described embodiments, an outer common tangential line between the position of the minimum diameter D2s and the position of the outer diameter D3 is a reference line A, and a maximum distance in which the opposing member enters the belt in the direction perpendicular to the reference line A is an entering amount λ. Further, similarly as in the above-described embodiments, a distance from the normal crown roller to the opposing member is a, and a distance from the opposing member to the stretching roller immediately downstream of the normal crown roller is b. Then, the entering amount λ may only be set so as to satisfy the following formula (1) similarly as in the above-described embodiments:

$$\lambda \geq (|D2s-D2m|/2)\times(b/(a+b)) \qquad \text{formula (1).}$$

Typically, the entering amount λ is not more than |D2s−D2m|/2.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-133767 filed on Jul. 2, 2015, which is hereby incorporated by reference herein in its entirety.

What is claimed is:

1. A belt feeding device comprising:

a movable endless belt configured to feed a recording material on which a toner image is carried;

a plurality of rollers contacting an inner peripheral surface of said movable endless belt and including a first roller, an opposing roller and a second roller, wherein said first roller is smaller in diameter at a central portion than at an end portion in a region including a belt contact region thereof with respect to a rotational axis direction thereof, wherein said opposing roller is provided downstream of and adjacent to said first roller with respect to a movement direction of said movable endless belt and is constant in diameter in a region including a belt contact region thereof with respect to a rotational axis direction thereof, and wherein said second roller is provided downstream of and adjacent to said opposing roller with respect to the movement direction of said movable endless belt and is constant in diameter in a region including a belt contact region thereof with respect to a rotational axis direction thereof; and a rotatable brush roller configured to remove toner deposited on an outer peripheral surface of said movable endless belt, wherein said rotatable brush roller is provided at a position opposing said opposing roller via said movable endless belt and contacts the outer peripheral surface of said movable endless belt, wherein the following relationship is satisfied:

$$(|D2s-D2m|/2)\times 10 \geq \lambda \geq (|D2s-D2m|/2)\times(b/(a+b)),$$

where as seen in the rotational axis directions,

D2m is a minimum diameter of said first roller,

D2s is a maximum diameter of said first roller,

λ is an entering amount in which an outer peripheral surface of said opposing roller enters said rotatable brush roller with respect to a reference line A which is an outer common tangential line at a stretching side of said movable endless belt between a portion of said first roller having the minimum diameter D2m and said second roller, a is a distance between a rectilinear line passing through a rotation center of said first roller and perpendicular to the reference line A and a rectilinear line passing through a rotation center of said opposing roller and perpendicular to the reference line A, and b is a distance between a rectilinear line passing through a rotation center of said second roller and perpendicular to the reference line A and the rectilinear line passing through the rotation center of said opposing roller and perpendicular to the reference line A.

2. A belt feeding device according to claim 1, wherein the following relationship is satisfied:

$$(|D2s-D2m|/2)\times 5 \geq \lambda.$$

3. A belt feeding device according to claim 1, wherein the following relationship is satisfied:

$$(D2s-D2m)/2) \geq \lambda.$$

4. A belt feeding device according to claim 1, further comprising a collecting roller which contacts said rotatable brush roller and onto which the toner removed by said rotatable brush roller is electrostatically moved.

5. A belt feeding device according to claim 1, wherein said plurality of rollers further includes a third roller provided upstream of and adjacent to said first roller with respect to the movement direction of said movable endless belt, and wherein said third roller is larger in diameter at a central portion than at an end portion in a belt contact region thereof with respect to a rotational axis direction thereof.

6. A belt feeding device according to claim 5, wherein one of said plurality of rollers is provided upstream of said third roller and downstream of said second roller with respect to the movement direction of said movable endless belt and forms a transfer portion where the toner image is transferred from an image bearing member onto the recording material.

7. A belt feeding device comprising:

a movable endless belt configured to feed a recording material on which a toner image is carried;

a plurality of rollers contacting an inner peripheral surface of said movable endless belt and including a first roller, an opposing roller and a second roller, wherein said first roller is different in diameter at a central portion from at an end portion in a region including a belt contact region thereof with respect to a rotational axis direction thereof, wherein said opposing roller is provided downstream of and adjacent to said first roller with respect to a movement direction of said movable endless belt and is constant in diameter in a region including a belt contact region thereof with respect to a rotational axis direction thereof, and wherein said second roller is provided downstream of and adjacent to said opposing roller with respect to the movement direction of said movable endless belt and is constant in diameter in a region including a belt contact region thereof with respect to a rotational axis direction thereof; and a rotatable brush roller configured to remove toner deposited on an outer peripheral surface of said movable endless belt, wherein said rotatable brush roller is provided at a position opposing said opposing roller via said movable endless belt and contacts the outer peripheral surface of said movable endless belt, wherein the following relationship is satisfied:

$$(|D2\max - D2\min|/2)\times 10 \geq \lambda \geq (|D2\max - D2\min|/2)\times(b/(a+b)),$$

where as seen in the rotational axis directions,

D2max is a maximum diameter of said first roller,

D2min is a minimum diameter of said first roller,

λ is an entering amount in which an outer peripheral surface of said opposing roller enters said rotatable brush roller with respect to a reference line A which is an outer common tangential line at a stretching side of said movable endless belt between a portion of said first roller having the minimum diameter D2min and said second roller, a is a distance between a rectilinear line passing through a rotation center of said first roller and perpendicular to the reference line A and a rectilinear line passing through a rotation center of said opposing roller and perpendicular to the reference line A, and b is a distance between a rectilinear line passing through a rotation center of said second roller and perpendicular to the reference line A and the rectilinear line passing through the rotation center of said opposing roller and perpendicular to the reference line A.

8. An image forming apparatus comprising:

a toner image forming unit configured to form a toner image;

an intermediary transfer member configured to temporarily carry the toner image which is formed by said toner image forming unit and which is transferred onto a recording material;

a movable endless belt configured to feed the recording material to which the toner image is transferred from said intermediary transfer member;

a plurality of rollers contacting an inner peripheral surface of said movable endless belt and including a first roller, an opposing roller and a second roller, wherein said first roller is smaller in diameter at a central portion than at an end portion in a region including a belt contact region thereof with respect to a rotational axis direction thereof, wherein said opposing roller is provided downstream of and adjacent to said first roller with respect to a movement direction of said movable endless belt and is constant in diameter in a region including a belt contact region thereof with respect to a rotational axis direction thereof, and wherein said second roller is provided downstream of and adjacent to said opposing roller with respect to the movement direction of said movable endless belt and is constant in diameter in a region including a belt contact region thereof with respect to a rotational axis direction thereof; and a rotatable brush roller configured to remove toner deposited on an outer peripheral surface of said movable endless belt, wherein said rotatable brush roller is provided at a position opposing said opposing roller via said movable endless belt and contacts the outer peripheral surface of said movable endless belt, wherein the following relationship is satisfied:

$$(|D2s - D2m|/2)\times 10 \geq \lambda \geq (|D2s - D2m|/2)\times(b/(a+b)),$$

where as seen in the rotational axis directions,

D2m is a minimum diameter of said first roller,

D2s is a maximum diameter of said first roller,

λ is an entering amount in which an outer peripheral surface of said opposing roller enters said rotatable brush roller with respect to a reference line A which is an outer common tangential line at a stretching side of said movable endless belt between a portion of said first roller having the minimum diameter D2m and said second roller, a is a distance between a rectilinear line passing through a rotation center of said first roller and perpendicular to the reference line A and a rectilinear line passing through a rotation center of said opposing roller and perpendicular to the reference line A, and b is a distance between a rectilinear line passing through a rotation center of said second roller and perpendicular to the reference line A and the rectilinear line passing through the rotation center of said opposing roller and perpendicular to the reference line A.

9. A belt feeding comprising:

a movable endless belt configured to feed a recording material on which a toner image is carried;

a plurality of rollers containing an inner peripheral surface of said movable endless belt and including a first roller, an opposing roller and a second roller, wherein said first roller is smaller in diameter at a central portion than at an end portion in a belt contact region thereof with respect to a rotational axis direction thereof, wherein said opposing roller is provided downstream of and adjacent to said first roller with respect to a movement direction of said movable endless belt and is constant in diameter in a belt contact region thereof with respect to a rotational axis direction thereof, and wherein said second roller is provided downstream of and adjacent to said opposing roller with respect to the movement direction of said movable endless belt and is constant in diameter in a belt contact region thereof with respect to a rotational axis direction thereof; and a rotatable brush roller configured to remove toner deposited on an outer peripheral surface of said movable endless belt, wherein said rotatable brush roller is provided at a position opposing said opposing roller via said movable endless belt and contacts the outer peripheral surface of said movable endless belt, wherein the following relationship is satisfied:

$$(|D2s-D2m|/2)\times 10 \geq \lambda \geq (|D2s-D2m|/2)\times(b/(a+b)),$$

where as seen in the rotational axis directions,

D2m is a minimum diameter of said first roller,

D2s is a maximum diameter of said first roller, $\lambda$ is an entering amount in which an outer peripheral surface of said opposing roller enters said rotatable brush roller with respect to a reference line A which is an outer common tangential line at a stretching side of said movable endless belt between a portion of said first roller at a central portion with respect to a rotational axis direction thereof and a portion of said second roller at a central portion with respect to a rotational axis direction thereof, a is a distance between a rectilinear line passing through a rotation center of said first roller and perpendicular roller and perpendicular to the reference line A, and b is a distance between a rectilinear line passing through a rotation center of said second roller and perpendicular to the reference line A and the rectilinear line passing through the rotation center of said opposing roller and perpendicular to the reference line A.

* * * * *